US008097801B2

(12) United States Patent
Gannon

(10) Patent No.: US 8,097,801 B2
(45) Date of Patent: Jan. 17, 2012

(54) SYSTEMS AND METHODS FOR COMPOSING MUSIC

(76) Inventor: Peter Gannon, Victoria (CA)

( * ) Notice: Subject to any disclaimer, the term of this patent is extended or adjusted under 35 U.S.C. 154(b) by 382 days.

(21) Appl. No.: 12/290,929

(22) Filed: Nov. 5, 2008

(65) Prior Publication Data

US 2009/0260507 A1 Oct. 22, 2009

Related U.S. Application Data

(60) Provisional application No. 61/125,237, filed on Apr. 22, 2008.

(51) Int. Cl.
*G10H 1/38* (2006.01)

(52) U.S. Cl. ..... 84/613

(58) Field of Classification Search ..... 84/613
See application file for complete search history.

(56) References Cited

U.S. PATENT DOCUMENTS 5,990,407 A * 11/1999 Gannon ..... 84/613
2009/0019995 A1 * 1/2009 Miyajima ..... 84/625

* cited by examiner

*Primary Examiner* — Jianchun Qin
(74) *Attorney, Agent, or Firm* — John Janeway

(57) ABSTRACT

Generating a musical composition from one or more portions of one or more performances of one or more musical compositions included in a database is disclosed. The method and system include selecting a portion of a pre-recorded composition based on a degree of similarity with the component of the composition that is input; portions that are musically similar but not musically the same as the component may be selected for addition to the composition. The degree of similarity may be based on a ChordScore and/or a ScaleScore of the retrieved portion of the pre-recorded compositions. A ChordScore is generated by comparing chord tones of one or more chords in the pre-recorded portion with chord tones of the input component. A ScaleScore is generated by comparing tones of one or more notes in the pre-recorded portion with tones in a harmonic scale associated with the input component's chords.

29 Claims, 4 Drawing Sheets

A Method for Selecting a Riff

A Method for Generating a Database of Pre-recorded Musical Compositions

SYSTEMS AND METHODS FOR COMPOSING MUSIC

CROSS REFERENCE TO RELATED APPLICATION AND CLAIM OF PRIORITY

This application claims priority from commonly owned U.S. Provisional Patent Application 61/125,237, filed 22 Apr. 2008, and titled Methods And Systems For Improvising A Riff Using Previously Recorded Riffs, presently pending, which is incorporated by reference.

BACKGROUND

There are many computer programs to help a musician practice and/or compose music. For example, one such program is discussed in U.S. Pat. No. 5,990,407, which is incorporated by reference into this patent application. This program allows users to type in a chord progression, and then adds an improvisation to it as follows. The program works by looking at the first part of the user's chord progression (e.g. 4 bars|Dm7|G7|C|Bb7|A7) and then comparing it with a database of chord progressions that also have professional musical solos (riffs) recorded and stored as digital audio. When the program finds an exact chord progression match (Dm7|G7) the program selects that solo performance and starts to build the solo. Since the program has now written 2 bars, it moves to bar 3, where the chord progression is |C|Bb7|A7, and searches for an exact chord progression match.

Unfortunately there are a couple of problems with this program. The current program requires a large number of riffs so that an exact match for each possible chord progression can be found. Because storing digital audio requires a large storage space, storing a large number of riffs in digital audio requires a lot of disk space. Also, because the program searches for an exact match, a long riff that has a similar but not identical chord progression to the user's chord progression would be rejected. Thus, the riffs chosen by the program are usually short, no more than a few beats or bars. This makes the composition sound unnatural, unlike longer riffs that sound more complete and musically pleasant. Also, because the program searches for an exact match, riffs with notes that would sound good over the user's chord would be rejected.

If the program allowed the same riff to be used over many different chord progressions, instead of just one, fewer riffs would be required and thus less disk space would be needed. In addition, if the program allowed riffs with compatible notes but not identical chords to be chosen, fewer riffs would be required and more varied compositions could be created.

SUMMARY

Aspects of the invention include a method and a system for generating a musical composition from one or more portions of one or more performances of one or more musical compositions included in a database. Other aspects of the invention include creating a database that includes one or more performances of one or more musical compositions and other musical data associated with the one or more performances.

In one embodiment, a method for generating a musical composition includes 1) receiving a component of the musical composition; 2) determining a first parameter based on the component; 3) retrieving a portion of a pre-recorded musical composition from a database that includes portions of one or more pre-recorded musical compositions; 4) determining a second parameter based on the retrieved portion; 5) comparing the first parameter to the second parameter to determine a degree of similarity between the component and the portion; and 6) selecting the portion of the pre-recorded musical composition based on the degree of similarity between the first and second parameters. By basing the selection of a portion of the pre-recorded musical composition on the degree of similarity with the component of the composition that is input, portions that are musically similar but not musically the same as the component can be selected for addition to the composition. Thus, a smaller number of musical performances may be used, and longer portions can be selected.

The degree of similarity may be based on a ChordScore and/or a ScaleScore of the retrieved portion of the pre-recorded musical compositions. A ChordScore is generated by comparing the chord tones of one or more chords in the pre-recorded portion with the chord tones of the input component. A ScaleScore is generated by comparing the tones of one or more notes in the pre-recorded portion with the tones in a harmonic scale associated with the input component's chords.

In another embodiment, a method for generating a database containing two or more portions of one or more pre-recorded musical compositions includes 1) storing a performance of a musical composition; 2) determining and storing a key signature, tempo, chord progressions and bar location times of the musical composition; 3) transcribing the stored performance into MIDI format; 4) locating one or more phrases included in the musical composition; 5) marking the stored performance at the start and at the end of the one or more phrases; 6) storing the location of the start and end markers; 7) determining chord data for one or more chords in each phrase; and 8) storing the chord data. By marking the start and end of portions of the performance, each portion of the performance does not have to be stored separately. This reduces the amount of storage that the database requires. By transcribing the performance into MIDI format, a Chordscore and ScaleScore for a portion can be easily determined by a computer program. Furthermore, with the MIDI format, a computer may display the performance, or the composition that is eventually generated, as it would be played on a musical instrument such as a piano, a guitar, a fiddle, or a banjo.

DETAILED DESCRIPTION

The invention includes a system and method for generating a musical composition based on a database of pre-recorded musical compositions. The composition that is generated may be a portion of a larger musical composition, such as a movement of a composition that includes three parts, or a portion of a single piece of music, such as a section of a song where one or more musicians improvise. The composition that is generated may even be added to the database of pre-recorded musical compositions to be used to generate other musical compositions. The pre-recorded musical compositions include digital audio, analogue audio or MIDI recordings of musical performances by one or more musicians. In operation, a user inputs a component, such as a chord progression, of the musical composition. A portion of a pre-recorded composition is then selected to be incorporated into the new composition based on the portion's degree of musical similarity to the component input by the user.

Figure 1:
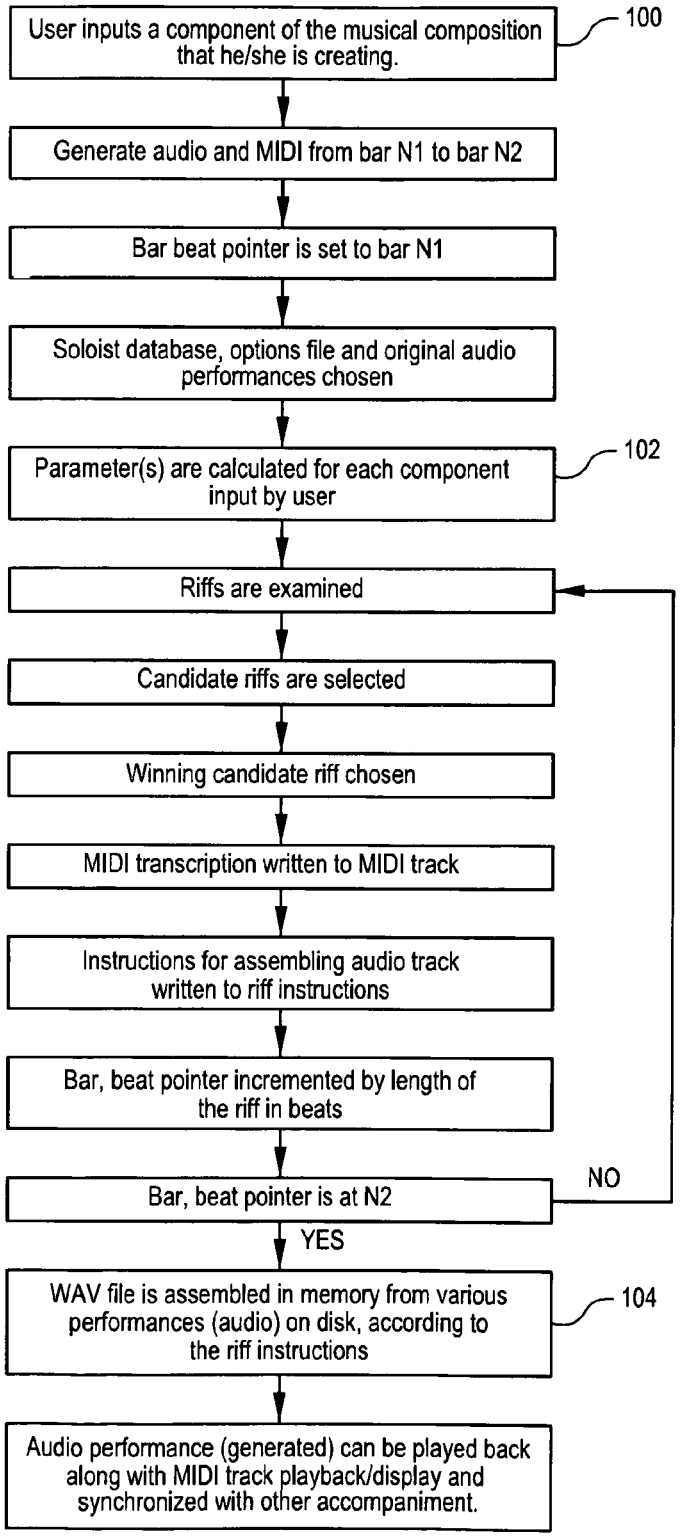
FIG. 1 is a flow chart showing a method for generating a musical composition based on a database of pre-recorded musical compositions, according to an embodiment of the invention.
Figure 2:
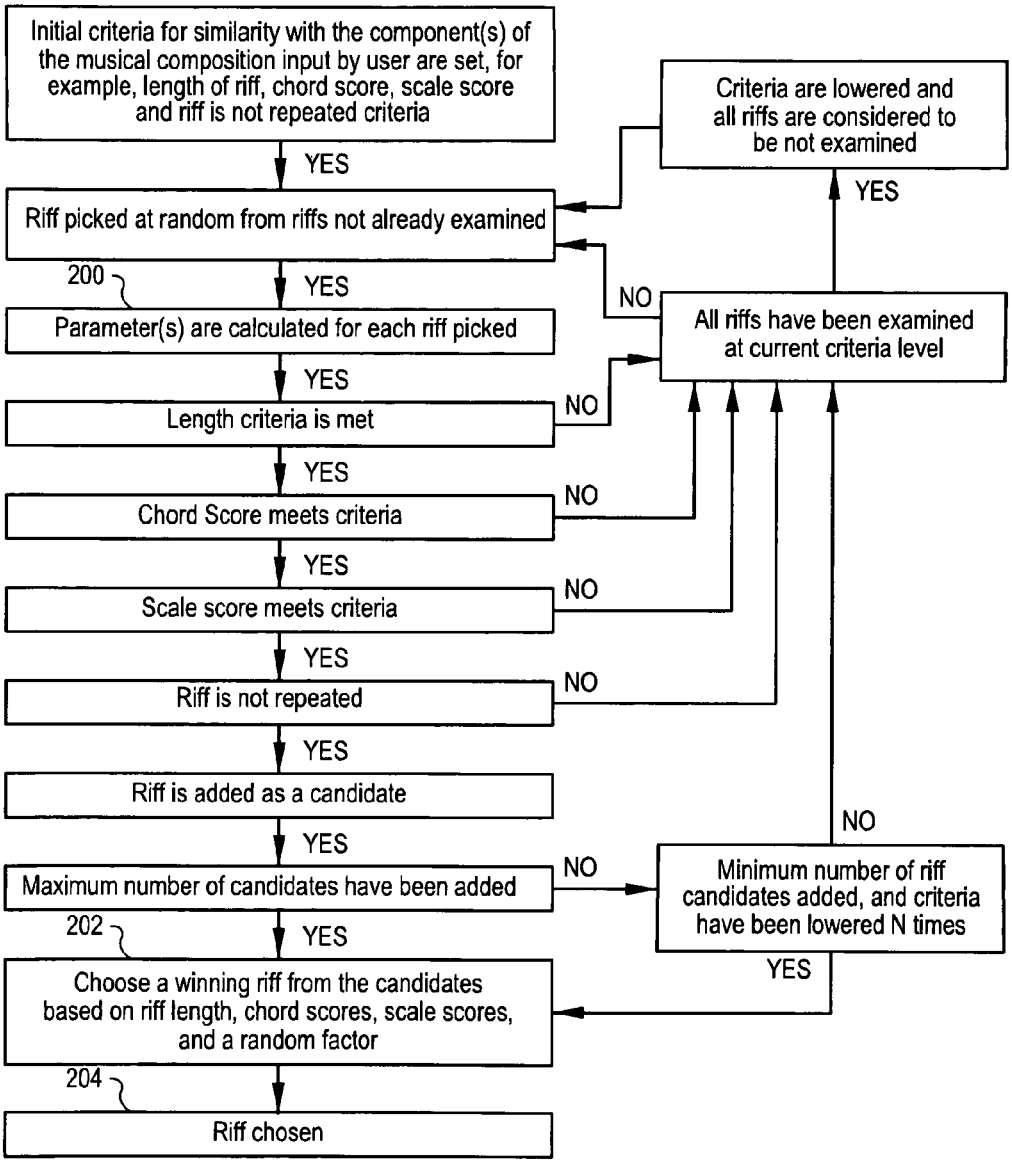
FIG. 2 is a flow chart showing a method for selecting a Riff (which is a component of the method shown in FIG. 1), according to an embodiment of the invention.
Figure 3:
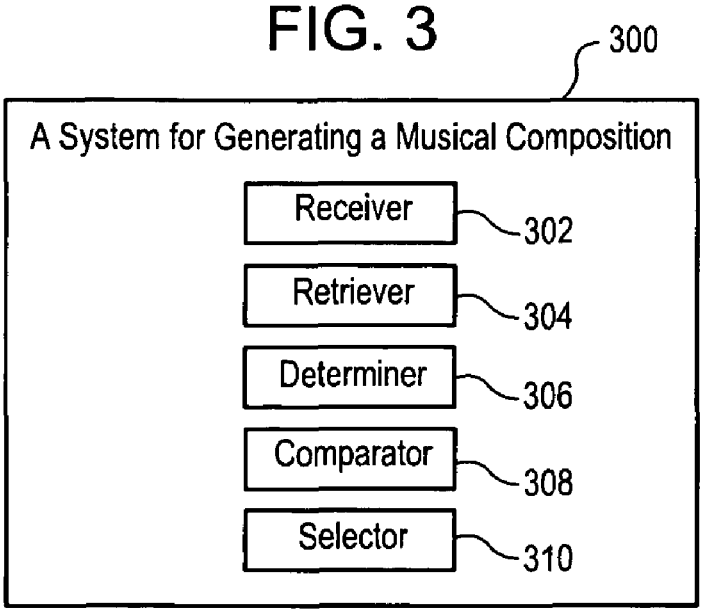
FIG. 3 is a schematic diagram of a system operable to generate a musical composition based on a database of pre-recorded musical compositions, according to an embodiment of the invention.

For example, in an embodiment shown in FIGS. 1-3 and discussed in greater detail elsewhere in this application, the user specifies a sequence of chords (100 in FIG. 1), including chord root and chord extension, and key signature. The system (300 in FIG. 3) then calculates a parameter for each (102 in FIG. 1). The parameter for the chord represents the chord scale for that chord root, extension, and key signature. Next, the system calculates a parameter for the sequence of chords and key signature for a pre-recorded portion (200 in FIG. 2). The system then compares the user-specified sequence of chords and parameters to the pre-recorded portion's sequence of chords and parameters (see FIG. 2) to determine whether or not the pre-recorded portion is similar enough to be added to the new composition. The system does this for each pre-recorded portion in the database. The system then examines the selected portions and chooses the portion that best meets one or more of the following criteria (1) a similar chord progression to the user chord progression (ChordScore), (2) MIDI transcribed notes in the portion that are found in the Scales associated with the user chord progression (ScaleScore), and other factors, like length of the portion, and whether it has already been played (202 and 204 in FIG. 2). The system then assembles the new composition in digital or analogue format, along with a MIDI transcription (104 in FIG. 1).

In one embodiment that is shown in FIG. 3, the system 300 for generating a musical composition includes a receiver 302 operable to receive a component of the musical composition; a retriever 304 operable to retrieve a portion of a pre-recorded musical composition from a database that includes portions of one or more pre-recorded musical compositions; a determiner 306 operable to determine a first parameter based on the component, and a second parameter based on the portion of the pre-recorded musical composition; a comparator 308 operable to compare the first parameter to the second parameter to determine a degree of similarity between the component and the portion; and a selector 310 operable to select the portion of the pre-recorded musical composition based on the degree of similarity between the first and second parameters.

The invention also includes a method and system for generating a database of pre-recorded musical compositions. For example, in an embodiment shown in FIGS. 4-5 and discussed in greater detail elsewhere in this application, a database (412 in FIG. 4) containing numerous digital audio musical compositions is created. The digital audio performances are analyzed, and data representing start and stop times for phrases in the performance is stored in a phrase markers text file (404 in FIG. 4). A MIDI transcription of each musical composition is also made (403 in FIG. 4). For each MIDI transcription, data is stored in a memory representing a sequence of note pitches, duration and timing for each note. In another embodiment the performances may instead be made as MIDI, not requiring a transcription. To the database is added a specification of the sequence of chord roots which is associated with the audio performances. The timing of the chord changes is matched to the timing data for the phrase markers in the text files and MIDI notes from the transcription. In addition to the chord roots, the extensions for each chord and the key signature for each performance are added.

Figure 5:
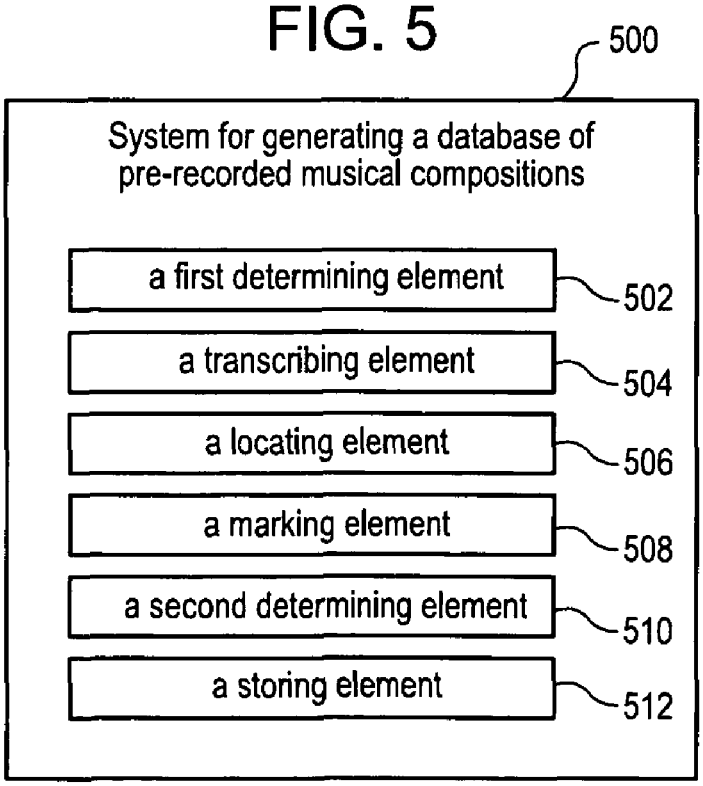
FIG. 5 is a schematic diagram of a system operable to generate a database of pre-recorded musical compositions, according to an embodiment of the invention.

In one embodiment that is shown in FIG. 5, the system 500 for generating a database of pre-recorded musical compositions includes a first determining element 502 operable to determine a key signature, tempo, chord progressions and bar location times of a performance of a musical composition; a transcribing element 504 operable to transcribe the performance into MIDI format; a locating element 506 operable to locate one or more phrases included in the musical composition; a marking element 508 operable to mark the performance at a start and at an end of the one or more phrases; a second determining element 510 operable to determine chord data for one or more chords in each phrase; and a storing element 512 operable to store: 1) the performance of the musical composition, 2) the key signature, the tempo, the chord progressions and bar location times of the musical composition, 3) the location of the start and end markers, and 4) the chord data.

An Embodiment for Generating a Database

Figure 4:
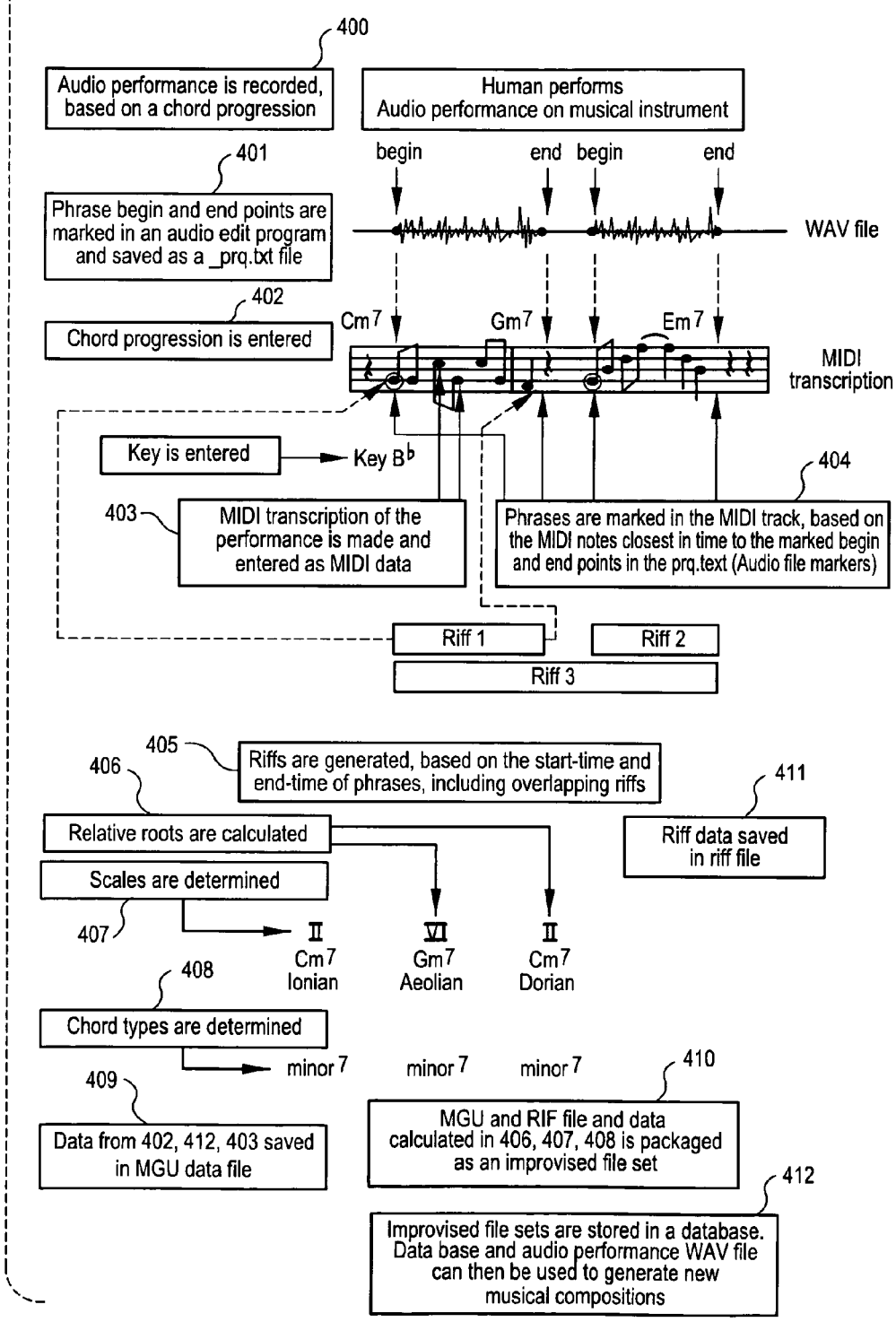
FIG. 4 is a schematic diagram and flow chart of a method for generating a database of pre-recorded musical compositions, according to an embodiment of the invention.

Referring to FIGS. 4 and 5, in one of many different embodiments of the method for generating a database containing numerous digital audio musical compositions, a computer program prepares multiple chord progression files. From the chord progression files, the program makes a backing (accompaniment) track file, and a style (e.g. Bossa Nova) that would be appropriate for the desired soloing style. The files are played back using the program, or another program capable of sequencing audio files. As the files are played back, a human musician improvises on a musical instrument, or his/her voice, and the program that is capable of sequencing audio files, records the improvisation.

The improvisation may be in the desired style. For example, if a Pedal Steel background is desired, the musician may improvise a part typical of a Pedal Steel player backing up a singer or lead instrument. Or, if a Jazz Saxophone soloist is desired, the musician may improvise solos on a Saxophone.

The files are all recorded at the same tempo, which may be any desired tempo. For this discussion, the tempo is 140. Multiple files are prepared in this way, in multiple key signatures, typically 5. The files may then be transposed to other keys, so that all 12 keys are represented. In other embodiments, the transposition may occur when the audio file is assembled in memory.

Throughout this discussion, we refer to the current song that we are working on as Song1. We refer to the human musician audio recordings here as WAV-recordings, so the WAV recording for Song1 is called Song1.WAV. If we are processing Song1, then the Chord file, with key, tempo, and bar locations is stored as Song1.MGU, which is a program file.

The WAV recordings are then transcribed into MIDI data format. Transcription may be a manual process performed by a person, or the transcription may be performed or aided by conventional pitch-to-MIDI transcription software, like WIDI or Melodyne, and then reviewed by a person for accuracy and, if required, corrected by a person. The MIDI data is added to the Song1.MGU, using the MIDI import feature of the program. The Song1.MGU now contains Chords, Bar Location Times, Tempo, and MIDI transcription, so we refer to it as a ChordMIDIFile.

The WAV recordings are then analyzed, by a person, for example, using a conventional WAV editing program like Adobe Audition. Markers are added to the WAV recordings to indicate the start and end of musical phrases. A marker that is placed at the start of a phrase is a 'P' marker, and a marker placed at the end of a phrase is a 'Q' marker. Another marker, 'R', may be added to indicate sub-phrase start points within a phrase. The markers may be added using time units of bars, beats and ticks, using a parts-per-quarter-note of 1200 ticks per beat. The first bar number may be a bar negative one (−1), and the first two bars are blank to allow for a lead-in silence. These markers are added to the WAV file, and then extracted from the WAV file, either by typing the numbers manually, or by using a program to extract markers and write a text file from the extracted markers. The markers may be placed into a text file, Song1_PRQ.txt. For example, an excerpt of a PRQ file is below.

P=1, 1, 1162; Bar 1, Beat 1, Tick 1162 with parts per quarter note (PPQ)=1,200

Q=2, 2, 844
P=2, 2, 844
Q=2, 4, 960
P=3, 2, 1143
P=4, 2, 885
P=5, 1, 308
Q=6, 3, 225
P=6, 3, 958
P=7, 2, 262
Q=8, 1, 741
P=9, 2, 110
P=9, 3, 902
P=10, 1, 872
Q=10, 4, 439

The first entry (P=1, 1, 1162) marks the start of a phrase at Bar 1, Beat 1, tick 1162 (using a PPQ of 1,200, so that tick 64 is 64/1200 of a beat). The next entry (Q=2, 2, 844) marks the end of the same phrase at Bar 2, Beat 2, Tick 844. Thus the phrase lasts about 6 beats, from Bar 1, beat 1 to Bar 2, beat 2.

To this point, three files have been generated for Song 1, the ChordMIDIFile (Song1_MGU), the audio recording file (Song1.WAV), and the phrase marking file (Song 1_PRQ.txt).

The program then generates a file (song1.RIF) that contains a portion of the WAV recordings. These portions are portions of pre-recorded musical compositions and throughout this discussion may also be called Riffs.

To generate the Riff file, the program opens the associated Song 1_PRQ.txt file. For each (P=) marker that it finds, it creates a Riff file starting at the P value, and ending at a Q value, up to a limit in length of 8 bar phrases (32 beats). In the example above, for the first P entry (P=1, 1, 1162), a riff would be created from that point to each of the end points (Q=2, 2, 844) (Q=2, 4, 960) (Q=6, 3, 225) and to (Q=8, 1, 741). In one embodiment, for riffs more than 2 beats in duration, the start point of the riff is moved back in time to the nearest bar boundary, with offset values representing the distance from the start of the riff to the start of the musical data, and the end point is moved ahead in time to the next bar line. For riffs 2 beats or shorter in duration, the riff start/end points are moved back/ahead, respectively, to the nearest beat. This creates 4 riffs. The next Q (Q=10, 4, 439) is more than 8 bars from the P, so would result in a phrase that is too long, and thus, in this embodiment, a riff would not be created for that phrase. Then the next P for the song is located, and the process repeated.

For each riff that is created, the phrase start time (P=) and the end time (Q=) are stored. We also find the nearest point in the MIDI transcription for the P and Q values, and store data about the MIDI notes, such as first MIDI note, last MIDI note, number of MIDI notes, highest MIDI note, and lowest MIDI note.

For ChordMIDIFile (Song1_MGU) chord data is calculated from the chord root, chord extension, and key signature. The scale to use for the chord, relative root, and chord extension, may also be calculated and stored in a ScaleChordRootDataArray.

For each Wav-recording the following information is packaged into an Improvised File Set:

The transcribed MIDI data.

Chord symbols and key signature.

Calculated data, such as scales, chord extensions, and relative roots, and

Riff data based on #1, #2 #3.

Items 1-3 are stored in a .MGU data file. Item #4 is stored in a .RIF data file.

The database includes multiple Improvised File Sets that are combined as described in U.S. Pat. No. 5,990,407, which is incorporated herein by reference. Thus, a database may include the phrases (riffs) that are found in the WAV-recordings, and the audio data for the Wav-recordings.

An Embodiment for Generating a Musical Composition

Referring to FIGS. 1 and 3, in one of many different embodiments of the method for generating a musical composition based on a database of pre-recorded musical compositions, for example the database discussed above, chord symbols, tempo, key, and chosen style of music may be entered into a program. From these components of the musical composition to be generated, the following data may be calculated for each beat.

Scale Number,

Chord Number,

Relative Root,

This data may be stored in a ScaleChordRootData Array for the new composition, which in this example is an improvisation for the entire composition.

Options for the generating the composition may be set by the user. These may control parameters of the generated improvisation, and may be stored in a TSoloist structure which stores information such as the title of the soloist, title of the new composition, the name of the database to use, and the location of the WAV files folder. This may be stored in a folder called RealTracks, and a subfolder with the same name as the ST2StyleName, or another name marked with a double caret ^^ to indicate that this is the name to use. For example, a collection of improvisations might be for a Pedal Steel background, and we might call the database RealPed.st2 (found in c:\bb\RealPed.st2), and the files would be found in c:\bb\RealTracks\RealPed folder. The files would be Song1.WAV, Song2.WAV etc.

Generating an improvisation includes repeatedly picking portions of pre-recorded musical compositions, which are portions of the WAV recordings in the database discussed above and may also be called Riffs throughout the remainder of this discussion. The process of selecting a Riff is not discussed now, but will be discussed later. Each Riff has a certain duration, and, if selected, results in a certain number of beats of the improvisation being written. When a Riff is selected, the Riff is written to the improvisation track as MIDI data, starting at the track pointer. The Riff also points to the area of the WAV file that should be used for the digital audio improvisation, using the start point (P), end point (Q) and filename (e.g. song1.WAV) that are stored in the Riff. The information for assembling of the WAV file is stored in a Riff Instructions file. Then, the track pointer is incremented by the number of beats in the selected Riff, and the process of choosing another Riff and writing MIDI data that the Riff points to is repeated. At the end of the process, a complete MIDI improvisation has been written to the MIDI track in the program, and complete instructions for assembling the solo improvisation, such as P, Q, WAV filename, and the destination bar/beat location for the new WAV file improvisation, are stored in the Riff instructions file. The WAV file of the new improvisation is now assembled in memory, by reading in the portions that are specified in the Riff instructions, and are placed at the destination location in the WAV file being assembled.

For example, if the first Riff chosen is from Song7.WAV with a start time, P, at Bar 23, Beat 1, Tick 586), an end time, Q, at Bar 27, Beat 3, Tick 233, and a destination of Bar 1 in the new improvisation; then we read in that portion of the Song7.WAV file and place it at the location for Bar 1 of the WAV file being assembled in memory. We repeat this process for all of the Riffs so that we have in memory a file representing a complete composition. As the digital audio files are assembled, standard techniques like cross fading and zero crossings are used to minimize digital noise at the start and end of each digital audio file.

A complete improvisation, in both MIDI format (transcription of the digital audio), and audio format (assembled portions of the original performance) has now been generated. We can play the audio for the user to hear, and also display notation, and on-screen piano roll, animated keyboard/guitar for the MIDI data corresponding to the composition, or even play the MIDI data as well (or instead) of the digital audio data.

An Embodiment for Selecting a Riff (ChordScale)

Referring to FIGS. 2 and 3, in one of many different embodiments for selecting a Riff, the current location of the Bar of the solo improvisation to which the Riff will be added is established and a search for a Riff that is the best choice for that Bar commences. The best choice is determined by the specific Riff's degree of similarity to the components of the solo improvisation to be generated. Each Riff that is chosen for an analysis of its degree of similarity are scored for various criteria, including ChordScore (similarity of chord progression between the Riff and the solo improvisation), ScaleScore (compatibility of notes in the riff with a scale of the chord progression in the solo improvisation), NumBeats (length of Riff in beats) and RifflsRepeated (the number of times that the riff has already been played).

A scale for a chord progression may be defined by the chord root of a chord in the progression, a chord extension of a chord in the progression, a key signature, and other chords that follow the progression. A scale may be assigned for each beat of the improvisation. Each chord extension may be classified into one of ten chord types using a lookup table that includes more than one hundred chords. The ten types of chords are: major, major7, minor, minor7, minor7b5, diminished, suspended, suspended7, lydian dominant, and altered dominant. Based on the chord type, the relative root of the chord, and the next chord, a scale may be assigned from a list of fourteen possible scales. The possible scales are: Ionian Major, Lydian Major, Dorian Minor, Phrygian Minor, Aeolian Minor, Harmonic Minor, Mixo-Lydian Dominant, Mixo-Lydian Resolving, Lydian Dominant7, Altered Dominant, Blues, Suspended, Half-Diminished, and Diminished. For example, A minor (Am) chord in the key signature of C has a chord root of A, which is numerically the $6^{th}$ degree of the C scale. A minor chord on the $6^{th}$ degree of the major Scale is an Aeolian minor scale, which uses the notes A, B, C, D, E, F, and G. In another example, an A minor (Am) chord in the key signature of G has a chord root of A, which is numerically the 2nd degree of the G scale. A minor chord on the 2nd degree of the major Scale is a Dorian minor scale, which uses the notes A, B, C, D, E, F#, and G.

Each riff may be examined, and a numerical score may be determined for the ChordScore, and ScaleScore.

The ChordScore is a way of numerically representing how musically similar the user's chord progression is with the chord progression in the considered Riff. In general, chords that share chord tones (and to a lesser extent scale tones) are musically similar. A chord that shares chord tones with another chord will be considered similar, and the score will reflect the number of chord tones that are shared, and for the ones that aren't shared, how far in or out of the scale of the other chord that they are.

For example, in the key of C, if the user has entered a CMaj7 chord, and the Riff has a Em7 chord, these chords are similar, because the chord tones of a Em7 chord are E, G, B, and D, and 3 of these are chord tones of the CMaj7 (E, G, and B), and the one that isn't (D) is a scale tone of the CMaj7. So, comparing Em7 in the Riff with CMaj7 in the user's chord progression would yield a very low ChordScore, which implies a high degree of similarity and compatibility with the chords. Thus, the Riff on Em7 would be a good choice for a user input chord of CMaj7. A Riff on CMaj7 would be better because the two chords would be the same, but it might be not suitable for other reasons, such as it has already been played or it isn't long enough. An ideal ChordScore would be zero, meaning that the chord scale of the riff matches the chord scale of the song exactly.

For each beat in the riff, we may also compare the ChordRoots (a number from 0 to 11 semitones above the key signature), and Scale Numbers (calculated as above and in U.S. Pat. No. 5,990,407) of the Riff with the user's input. To do this we may start with the root of the source scale. If the Riff we are evaluating (the source) is a Gm7 chord in the key of Bb, this would be calculated to be a Bb Aeolian Scale (G, A, Bb, C, D, Eb, and F). Then we may compare this to the user chord and scale for that beat. For example, if the user's input chord is in the key of Eb, and the user's input chord is Fm7. We may calculate the user scale to be Fm Dorian. (F, G, Ab, Bb, C, D, Eb, and F).

We may evaluate the chord score for this as ChordScore=ChordCompatibilityScore (Source Root, SourceScale, ComparedToRoot, ComparedToScale:Byte): integer. Using the example above, ChordScore=ChordCompatibilityScore (G, Aeolian, F, Dorian). To calculate this, we simplify it by transposing to the key of C, so that it will be the same value as ChordScore=ChordCompatibilityScore (D, Aeolian, C, Dorian). To evaluate this chord score example, the root, $3^{rd}$, $5^{th}$, $7^{th}$, $9^{th}$, $11^{th}$, and $13^{th}$ notes may be calculated for the D Aeolian and stored in a Notes array as the notes D, F, A, C, E, G, and Bb (numerically represented by 2, 5, 9, 0, 4.7, and 10). Next the root, $3^{rd}$, $5^{th}$, $7^{th}$, $9^{th}$, $11^{th}$, and $13^{th}$ notes may be calculated for the C Dorian and stored in a ComparedToNotes array as the notes C, Eb, G, Bb, D, F, A (numerically represented by 0, 3, 7, 10, 2, 5, 9).

We then compare each of the notes to the ComparedTo Scale (C Dorian, which is C, Eb, G, Bb, D, F, A (numerically represented by 0, 3, 7, 10, 2, 5, 9). We may use a lookup table for the 12 notes, and the 14 scales. Notes that are chord tones may be assigned a value of 0, scale tones may be a value of 1 for commonly used scale tones, 2 for uncommonly used scale tones, 3 for an out of scale note, mildly dissonant, and 4 for an out of scale note, very dissonant. The assignment to chord tones, scale tones, or out-of-scale tones may be according to standard music theory that defines the chord tones as root, $3^{rd}$, $5^{th}$, and $7^{th}$ of a scale, with the scale tones being other notes in the scale that are not chord tones. The further assignment as to common vs. uncommon scale tones, and mildly vs. very dissonant may also be based on standard music theory and practice. This table may be pre-prepared, with the help of musicians familiar with the style of music for the final assignment of the scale tones values of 1 or 2, and the out-of-scale tone values of 3 or 4.

For the C Dorian scale, the values may be as follows:

Assign array called ScaleOutside2 for DORIAN,

0{C note is 0},4 {Db}, 1{D},0{Eb},4{E},1{F},4{F#}, 0{G},4{Ab},2{A},0{Bb},3{B});

The values we get for the note array (D, F, A, C, E, G, Bb) may be penalty values for reading from the ScaleOutside2 for Dorian array as above:

1{D},1{F},2{A},0{C},4{E},0{G},0{Bb}

If the Chords share any chord tones or scale tones, then the penalty for that shared chord tone may be zero. This may be represented by comparing the Notes and ComparedTo arrays for each of the 6 scale tones. In this example, they don't share any chord/scale tones. But chords like Dm7 and D7 would share multiple scale tones because the D is the root of both, the A is the $5^{th}$ of both, and the C is the $7^{th}$ of both. The Dm Aeolian chord's root, D, may have a mild penalty of 1 for the D note not being a chord tone, but being a good scale tone. The Dm Aeolian chord's third, F, may have a mild penalty of 1 for the F note not being a chord tone, but being a good scale tone. The Dm Aeolian chord's fifth, A, may have a moderate penalty of 2 for the A note not being a chord tone of Cm, but being a uncommon scale tone. The Dm Aeolian chord's seventh, C, may have no penalty for the C note because that is a chord tone of C Dorian. The Dm Aeolian chord's ninth, E, may have a severe penalty of 4 for the E note because that is a very dissonant chord tone of C Dorian. The Dm Aeolian chord's eleventh, G, may have no penalty for the G note because that is a chord tone of C Dorian. And, the Dm Aeolian chord's thirteenth, Bb, may have no penalty for the Bb note because that is a chord tone of C Dorian.

To calculate the total penalty for that chord, we may add up the various penalties 1{D}, 1{F}, 2{A}, 0{C}, 4{E}, 0{G}, and 0{Bb} after multiplying each of them by an importance factor. For example, chord tones 1, 3, 5, and 7 of the scale are much more important than scale tones so may have an importance multiplier of 3. Other scale tones 9, 11, and 13 may have less importance, and may be assigned a value of 1 when rarely used, such as the $13^{th}$ of a m7b5 scale, or may be assigned a value of 2 when commonly used, such as the $11^{th}$ of a minor chord. These multipliers are stored for each of the scales, and are applied based on the source scale.

For the Aeolian scale in this example, the values may be as follows:

Assign the ScaleNotesImportance array for AEOLIAN,

3{root}, 2{13th}, 3{$3^{rd}$}, 2{11th}, 3{5th}, 13{$6^{th}$}, 3{$7^{th}$}

So the total penalty for the chord may be equal to 3+3+6+0+8+0+0 which is 20, as shown below.

$$3=3\times1\{D\}\{\text{ScaleNotesImportance for root}\},$$

$$3=3\times1\{F\}\{\text{ScaleNotesImportance for } 3^{rd}\},$$

$$6=3\times2\{A\}\{\text{ScaleNotesImportance for } 5^{th}\},$$

$$0=3\times0\{C\}\{\text{ScaleNotesImportance for } 7^{th}\},$$

$$8=2\times4\{E\}\{\text{ScaleNotesImportance for } 9^{th}\},$$

$$0=2\times0\{G\}\{\text{ScaleNotesImportance for } 11^{th}\}, \text{ and}$$

$$0=1\times0\{Bb\}\{\text{ScaleNotesImportance for } 13^{th}\}.$$

So the ChordScore in comparing a Gm7 (Aeolian) with Fm7 (Dorian) is 20. The biggest penalty in comparing the chords came from the A note, the $9^{th}$ of the Gm7 scale, because the A is very dissonant on an Fm7 scale. The chord tones (G, Bb, and D) added to the penalty because they are not chord tones of Fm7, except for the F note, which is a chord tone of both.

To summarize the one of many different embodiments of the method for calculating ChordScore, we may compare the chord tones (1, 3, 5, and 7) and scale tones (9, 11, and 13) of the Riff (source chord and scale) with the user's chord, and may assign penalties when the chord tones and scale tones of the Riffs chord aren't also chord tones or scale tones of the user's input chord, with a heavier penalty being assigned to the chord tones of the Riff that aren't chord tones of the user's input chord. In this example, the ChordScore for a specific beat has been calculated, but because a Riff includes more than one beat, we may repeat the ChordScore calculation for each beat of the riff, and average the ChordScores of each beat to generate a ChordScore for the Riff.

Other embodiments are possible. For example, only chord tones may be compared. This can be achieved by simply adjusting the ScaleNotesImportance array for the $9^{th}$, $11^{th}$, and $13^{th}$ to zero. For another example, a lookup table that includes predetermined values for similarities between source chords, which may or may not include chord roots and/or chord types, may be used.

Some types of music are simple in terms of the complexity of the chords (e.g. Metal Rock), and the Riffs don't vary based on the chord extension used. So, in this style of music, chord extension and chord scale may be ignored when determining degree of similarity between a Riff and the component of the musical composition input by a user. Therefore, another embodiment includes determining degree of similarity from only chord roots.

Some musicians don't think of chordal harmony in terms of chord symbols, but rather in terms of colors. For example, C Major might be blue and Am might be green. Therefore, yet another embodiment includes determining degree of similarity from colors only.

In still other embodiments, degree of similarity may be based on the type of chord, such as minor or major, only. This is most useful in pop music, where the chord scale is not used that much, just the chord root and extension.

In still other embodiments, degree of similarity may be based on any predetermined combination of note pitches, such as C, E, and G, that may be referred to as something other than a chord symbol.

Another Embodiment for Selecting a Riff (ScaleScore)

When a musician creates an improvisation or an accompaniment for a composition, the musician typically plays notes that are included in a chord of the composition or that are included in a harmonic scale of a chord of the composition. Notes out of the harmonic scale may be used if they are of short duration and resolve to (i.e. are followed by) more pleasant notes (e.g. passing tones). In a similar fashion, a ScaleScore for each Riff may be determined to help measure the Riffs degree of similarity to a component of the composition to be generated and input by the user, such as a chord and/or chord progression. The ScaleScore is a measure of how musically suitable the notes are for the current chord progression in the song. With a ScaleScore, we can find riffs that would sound musically pleasant when played with the components of the user's chord progression, that is, most or all of the notes are chord tones or commonly used scale tones, both of which sound pleasant.

In one of many different embodiments for selecting a Riff, the lower the ScaleScores the more similar the Riff is to the user's input component. For example, C, E, G, and B on a CMaj7 chord are all chord tones, and D is a commonly used scale tone for a CMaj7, so all of those notes may receive a ScaleScore of zero if found in a Riff, and if the user had entered the chord of CMaj7. Out-of-scale passing tones that are followed by chord tones, or commonly used scale tones, may be receive the same value as the scale note that follows them. For example, on a Cmaj7 chord input by a user, a Riff with a passing tone of a C# that has a short duration, and is followed by a D may get the same ScaleScore as a D note. Higher scale score values may indicate the presence of some notes that are either out-of-scale, such as a C# note on a CMaj chord, that are not passing tones, or are uncommonly used notes within the scale, such as a C note on a Bm7b5 chord.

In a manner similar to the chord tones discussed above, we may determine a chord root, one or more chord extensions, and/or a harmonic scale for the user's input chord progression. Then, in one of many different embodiments, we may evaluate all of the transcribed notes and determine a scale score for each of them, weighted by their duration, and position in the bar, and then averaged.

The scale score for a given note in the Riff, and a scale in the user's chord progression may be determined by a function called GetScaleOutside2, which returns a value of a 2 dimensional array called ScaleOutside2 with the scale and the note being the elements of the array. This function may return a value from 0 to 4, with 0 indicating a chord tone, 1 a commonly used scale tone, 2 an uncommon scale tone, 3 an out-of-scale tone, and 4 a badly out of scale tone. In one of many embodiments a Soloist type parameter may be stored with the database to indicate if the improvisation is to be an accompaniment or a soloist. For soloist improvisations, we may modify the GetScaleOutside2 function, so that a value of 1 may be returned for a ScaleScore of zero, since it is OK for soloists to play non chord tones, but not OK for accompaniment instruments to play non-chord tones.

A note that lasts a long time may have more importance to the ScaleScore than a note that lasts a short time. So, for example, when we have the ScaleScore for a particular note, we may add that note to a grid of sixteenth notes—30 ticks per column (on the X axis) and 1 note pitch (mod 12) per row (Y axis). For example, a note of middle C that starts one full beat after the riff has begun, and that lasts for 60 ticks will be placed on the grid starting at beat 2 (column 4) and row 0, and would also fill up beat 2 column 5. If that Middle C note has a ScaleScore of 2, then this ScaleScore of 2 would be added to each of Row 0, Column 4 and row 0, column 5 of the grid, as well as incrementing the count of notes in the column. In this way, we can calculate an average scale score for each sixteenth note in the grid, based on the average scale score of the notes that would be played at or prior to that time, and not be finished playing (still be heard) at that point.

Because notes that are in the grid in the $16^{th}$ note column at the start of the beat may be more important to a pleasant sounding improvisation than notes that are at an $8^{th}$ note boundary, which may be in turn more important than notes starting at the $2^{nd}$ or $4^{th}$ sixteenth, we may multiply the ScaleScore for each bar in the Riff. At beats 1 and 3 the ScaleScore may be multiplied by 3; at beats 2 and 4 the ScaleScore may be multiplied by 2; and at $8^{th}$ note boundaries the ScaleScore may be multiplied by 1.5. We may refer to this multiplier as the zPenalty. For example, if the only note in the Riff was a single C note lasting 60 ticks, and the user's chord progression was an Ebm7 in the key of Db (i.e. Ebm7 Dorian scale), the C would have a ScaleScore of 2. It would be entered on 2 columns—Beat 1, tick 0, and Beat 1, tick 30. The score for column 1 would be 2 multiplied by 3 (the zPenalty for a note on beat 1). The score for the second column would be 2 multiplied by 1 (the zPenalty for the note). Therefore, the total ScaleScore may be 6+2 or 8. The number of notes may be 2 (one note, but entered on to 2 columns). The average scale score for the riff may be 4 or 8/2. The ScaleScore for the entire Riff may be determined by multiplying the final value (4) by 100, so that the ScaleScore for the riff would be 400.

In this example, 400 is a very high ScaleScore, and suggests that this Riff is not that similar to the user's input component of the composition to be generated. This is because, in the example, the only note present is an unusual scale tone, and there aren't any chord tones present to reduce the scale score.

Related to the ScaleScore, we can also determine the total number of notes that received a GetScaleOutside2 rating higher than 3. These notes would be the worst type of notes to include in a performance, since they don't match the chords at all. In addition, a note that spans more than one column (i.e. N columns) in the grid may be counted as multiple notes (i.e. N notes). These are referred to as RTNumHonkers2, and may be used as separate criteria for selecting a Riff: This RTNumHonkers2 may represent a total of really bad notes for a given riff. A similar variable may be determined for each Riff, and called RTNumHonkers, which may represent the number of notes (x # of columns occupied by that note) that received a GetScaleOutside2 value higher than 2. This RTNumHonkers may represent a total of bad notes (as opposed to really bad notes) for a given Riff.

A composite score may now be determined for each Riff, and called a ScaleAndChordScore. This composite score may equal the formula ScaleScore+(ChordScore×4)+BeatPenalty, and may be used to finally choose between rifts that have passed other criteria. BeatPenalty may be the greater of zero and the duration in beats that the Riff is less than 12. For example, a Riff with duration of 4 has a BeatPenalty of 8 or 12−4.

After the ChordScore, ScaleScore, and ScaleandChordScore have been determined for each Riff. The Riffs with the best values for each of those parameters may be determined and stored in BestScaleScore, BestChordScore and BestScaleandChordScore. In one of many different embodiments for selecting a Riff, an initial set of criteria is established. For example, 1) the Riff must not have been played previously in the composition to be generated, 2) the Riffs duration must be more than 1 bar, and 3) the Riffs ChordScore must be zero. If a Riff satisfies this criteria, then the Riff may be added as a candidate for further analysis. If the minimum number of candidates has been found and all Riffs satisfying a certain criteria have been examined (a saved parameter called MINRTCandidates is used and this can be changed by the user as a parameter to create a more varied solo), or the maximum number of Riffs has been found (a MAXRTCandidates setting), then the candidate Riffs are further analyzed to select the best candidate for adding to the composition.

If no Riffs satisfy the initial criteria, then the criteria may be relaxed and the comparison process for each Riff proceeds again. For example, the criteria may be changed to the following: 1) the Riff may be repeated a few times in the composition, but not consecutively, 2) The Riffs duration may be more than 1 bar, 3) the Riffs ChordScore must be zero. The criteria may be relaxed as many times as necessary to find Riff candidate. For example, after several iterations, the criteria may be 1) the Riff may be repeated a few times in the composition, but not consecutively, 2) the Riff's duration may be more than 1 bar, 3) the ScaleScore must be less than 20, 4) the RTNumHonkers must be less than or equal to 10, 5) the RNumHonkers2 must be 0, and 6) the ChordScore must be less than 20.

Once two or more Riff candidates are found, the ScaleAndChordScore, in combination with a random factor, may be used to select the best candidate. In one example, each Riff candidate may be given a weighting according to the following formula:

Weighting for each Riff candidate=Highest ScaleandChordScore of all the Riff candidates+2−ScaleAndChordScore for the respective Riff.

Then, the Riffs most similar to the user's input component of the composition may be the Riffs having the highest scores. One rift may be chosen from this group of candidates by random selection, and each candidate may have a chance of selection proportional to its weight.

Once the rift is selected, the MIDI data may be written to a MIDI track at the current location of the composition, and the name of the associated digital audio file and start/stop points in the digital audio file may be written to the Riff instructions file. Next, the process of assembling the audio file composition may begin. In one of many different embodiments, each Riff Instruction is read, containing the name of the digital audio file, start and stop points in the file, the source tempo of the digital audio file on disk, and the destination tempo of the file in memory. In this embodiment, the destination tempo may be the same as the source tempo. This tempo may be different from the tempo in the composition. If so, then playback of the audio file may be tempo stretched to either a faster or slower tempo. This process of playing back audio at a tempo different than the source tempo while preserving pitch is conventional and common in the digital audio art. This allows the user to change the tempo of his song as it plays. The best quality of playback of the audio file occurs when there is no (or only small) stretching of the tempo.

As the composition plays, the user's improvisation portion of the composition is in sync with the one or more Riffs added to the composition, and any other arrangement generated, or other tracks recorded by the user. Tempo changes may be done in real time, keeping the improvisation in sync using conventional tempo stretching techniques. In one embodiment, the audio may be transposed in real-time also, using standard audio techniques for transposition, while keeping tempo constant.

In one of many different embodiments, a Riff may be selected by 1) Receiving input chords symbols from a user 2) determining a ScaleScore for a portion of a pre-recorded composition, at least partly based on the degree of similarity of MIDI notes of the portion to the chord symbols in the user's input, and 3) selecting the portion to play at least partly based on the portion's ScaleScore.

In this embodiment, we do steps 1 to 3, where the ScaleScore is determined at least partly based on the chord scales derived from the user chord symbols and key. This may be useful for sophisticated types of music like jazz, where chord scales are used to create performances. In other embodiments, we do steps 1 to 3, where the ScaleScore is determined at least partly based on the chord tones in the chord symbols. This may be useful for less sophisticated types of music like country or pop, where chord symbols alone form the basis of most improvised performances. In yet other embodiments, we do steps 1 to 3, where the ScaleScore is calculated at least partly based on the chord root in the chord symbols. This may be useful for music with simpler types of chords, like Heavy Metal Rock.

The ScaleScore based on chord symbols may be determined at least partly based on standard music theory rules that notes in the chord tones or scale would be more preferable in a performance than notes out of the scale. In other embodiments, we don't need to rely on music theory rules, and may instead just create a ScaleScore for the notes compared to a chord symbol, by creating a lookup table with the lookup parameters based partly on the notes in the Riff and the chords input by the user. This may be useful in certain simpler types of music, that don't depend on scales for performances, and we can just populate the table with empirical knowledge about the notes used in typical compositions. In still other embodiments, we can use a series of rules to determine the ScaleScore for a certain note and chord, instead of the lookup previously described.

In still other embodiments, a Riff may be selected by 1) Receiving as input a Slash Chord from a user 2) determining a parameter based at least partially on the Slash Chord, and at partially on the degree of similarity between the input Slash Chord and the Riff, and 3) selecting a Riff at least partly based on the parameter. A Slash Chord is a chord that has root that is different than the typical root of the chord. For example, the Slash Chord Cm/Bb would be a C minor chord, with a typical chord root of C, a minor chord extension, and a root of Bb. Normally the slash root is played by musicians as the lowest note of a chord voicing, or the root for the bass player. In other embodiments we do steps 1 to 3, wherein the parameter may be based on the Slash Chord that is heard when that portion of the component of the composition is played.

In yet other embodiments for selecting a Riff, Riffs for instruments that are chording instruments, such as a guitar, are considered. If the user is generating a composition for a specific chording instrument, it may be desirable to substitute the best possible chord for the actual chord that would match the user's chord when the database doesn't include a Riff made with the specific chording instrument. For example, if the user has entered a C7b9b13 chord, and the database doesn't contain a C7b9b13 chord from a guitar, then a simpler chord that is close to this chord, and is present in the database may be substituted, such as C7b9 chord. In still other embodiments, a simpler chord extension according to standard music theory may be substituted.

In still other embodiments, a Riff may be selected only if the key signature of the Riff matches the key signature of the composition. For example, a rift played on a G chord in the key of C, might not sound good on a G chord in the key of G. Therefore it may be advantageous to require that the key signatures of the Riff the composition match.

In still other embodiments, some Riffs may only be appropriate for certain parts of a composition, such as an intro, verse, chorus, and/or ending, because of their stylistic variation. Therefore, it may be advantageous to limit some Riffs to certain parts of a composition by comparing a stylistic variation parameter for the Riff to the location in the composition where the Riff might be added.

Some portions of the digital audio performance are unsuitable to be played over times in the user's chord progression where a new chord symbol has been entered. An example would be a bass guitar performance. Bass players should usually play the root of the chord when a new chord symbol is entered, so it would be incorrect to select a portion of the performance that doesn't start on the root of the chord. Therefore, in yet other embodiments for selecting a Riff, a NotForANewChord parameter may be determined for a Riff, and the selection of the Riff may be based at least in part on the NotForANewChord parameter.

In still other embodiments, the selection of the Riff may include 1) transcribing the pre-recorded compositions into MIDI notes, synchronized to the composition to be generated, 2) receiving input chord symbols from a user for a portion T of the composition, and 3) If the user has input a chord symbol CS within one-half beat of the start of portion T, only, then examining a plurality of portions of audio, and selecting only portions of the digital audio performance based at least in part on the first MIDI note synchronized with the audio portion matching the chord root of the chord.

In still other embodiments, a system may visually display a transcription of the Rift and/or composition to help educate a user learning music and/or how to play a musical instrument. For example, a Riff may be selected that is similar to an input chord progression, the Riff may then be transcribed into MIDI data, which may be used to aurally and visually display, in synch, the Riff being played on any desired instrument, such as a piano, guitar fretboard, or violin. In other embodiments of the system the MIDI data may be displayed in standard musical notation.

In still other embodiments, a system for selecting one or more Riffs may be included in a game played by one or more users. The game may be similar to the educational embodiment discussed above, but may also require that the user tap one or more keys, such as the spacebar of a computer keyboard, to the rhythm that he sees on the notation (or piano roll). The tapping may, in turn, trigger a program to play the WAV recording that corresponds to the portion of the user's composition that was playing when the user tapped the key. Because the game content is generated from Riffs that are selected based on a chord progression that can be input by the player, the game content can vary with each playing of the game. In other embodiments of the game, a user may attempt to tap the one or more keys, in synch, to the rhythm of the Riff. In one such embodiment, the program receives user input (tapped key) at time T2, and in response outputs a portion of the WAV recording that corresponds to the start time of the closest MIDI note to T2. The program continues this output while the key is pressed or until the next MIDI note occurs, whichever is sooner. In still other embodiments of the game, points are awarded to a user, and displayed on a monitor, based on how close in time the user input occurred in relation to a played MIDI note.

The preceding discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

What is claimed is:

1. A method for generating a musical composition, the method comprising:

receiving a component of the musical composition;

determining a first parameter based on the component;

retrieving a portion of a pre-recorded musical composition from a database that includes portions of one or more pre-recorded musical compositions;

determining a second parameter based on the retrieved portion;

comparing the first parameter to the second parameter to determine a degree of similarity between the component and the portion, wherein the degree of similarity is a first degree of similarity; and selecting the portion of the pre-recorded musical composition based on the first degree of similarity between the first and second parameters, and on a second degree of similarity between the first and second parameters, wherein the first and second parameters are less similar in the second degree of similarity than the first and second parameters in the first degree of similarity.

2. The method of claim 1 wherein the component received includes at least one of the following:

a chord included in the musical composition, a chord, a root of the chord, and an extension of the chord included in the musical composition, a chord progression included in the musical composition, a key signature for the musical composition, and a musical style for the composition.

3. The method of claim 1 wherein the first parameter includes at least one of the following:

a scale associated with the component, wherein the scale includes tones that when played simultaneously with the component are in harmony with the component, one or more tones included in the component, a relative root of the component.

4. The method of claim 1 wherein the first parameter includes at least one of the following:

a scale associated with the component, wherein the scale is defined by a chord root of a chord of the component, and a chord extension of the chord of the component, one or more tones included in the component, a relative root of the component.

5. The method of claim 1 wherein the first parameter includes at least one of the following:

a scale associated with the component, wherein the scale includes tones that when played simultaneously with at least one chord of the component are in harmony with the at least one chord, one or more tones included in at least one chord of the component, a relative root of at least one chord of the component, and a key signature of the component.

6. The method of claim 1 wherein each portion of the one or more pre-recorded musical compositions included in the database is retrieved.

7. The method of claim 1 wherein the second parameter includes at least one of the following:

one or more tones of one or more chords in the portion of the pre-recorded musical composition, one or more tones of one or more chord extensions of one or more chords in the portion of the pre-recorded musical composition, one or more tones of a scale associated with one or more chords in the portion of the pre-recorded musical composition, wherein the one or more tones are in harmony with the one or more chords, when the one or more tones are played simultaneously with the one or more chords, a key signature of the portion of the pre-recorded musical composition, the number of beats in the portion of the pre-recorded musical composition, and the number of times that the portion of the pre-recorded musical composition has been previously selected to be included in the musical composition.

8. The method of claim 1 wherein the portion of the pre-recorded musical composition is selected if at least one of the following are met:

one or more tones of one or more chords in the portion of the pre-recorded musical composition are the same as one or more tones of the component, one or more tones of one or more chords in the portion of the pre-recorded musical composition are the same as one or more tones included in a scale associated with the component, wherein the one or more tones included in the scale are in harmony with the component when played simultaneously with the component, one or more tones of one or more chord extensions of one or more chords in the portion of the pre-recorded musical composition are the same as one or more tones of the component, one or more tones of one or more chord extensions of one or more chords in the portion of the pre-recorded musical composition are the same as one or more tones included in a scale associated with the component, wherein the one or more tones included in the scale are in harmony with the component when played simultaneously with the component, one or more tones of a scale associated with one or more chords in the portion of the pre-recorded musical composition, wherein the one or more tones are in harmony with the one or more chords, when the one or more tones are played simultaneously with the one or more chords, are the same as one or more tones of the component, one or more tones of a scale associated with one or more chords in the portion of the pre-recorded musical composition, wherein the one or more tones are in harmony with the one or more chords, when the one or more tones are played simultaneously with the one or more chords, are the same as one or more tones included in a scale associated with the component, wherein the one or more tones included in the scale are in harmony with the component when played simultaneously with the component, a key signature of the portion of the pre-recorded musical composition is the same as the key signature of component, the number of beats in the portion of the pre-recorded musical composition exceeds 4, and the portion of the pre-recorded musical composition has not been previously selected to be included in the musical composition.

9. The method of claim 1 wherein selecting the portion of the pre-recorded musical composition based on the degree of similarity between the first and second parameters includes selecting the portion to be included in a subgroup of portions of one or more pre-recorded musical compositions that is to be evaluated again relative to the other portions selected to be included in the subgroup.

10. The method of claim 1 further comprising assembling the selected portion to the component to generate the musical composition.

11. The method of claim 10 further comprising:

playing a part of the musical composition, and visually displaying a part of the musical composition while the part is played.

12. The method of claim 10 further comprising:

playing a part of the musical composition, and receiving user input that triggers playing a portion of the pre-recorded composition while the part of the musical composition is played.

13. A system for generating a musical composition, the method comprising:

a receiver operable to receive a component of the musical composition;

a retriever operable to retrieve a portion of a pre-recorded musical composition from a database that includes portions of one or more pre-recorded musical compositions;

a determiner operable to determine a first parameter based on the component, and a second parameter based on the portion of the pre-recorded musical composition;

a comparator operable to compare the first parameter to the second parameter to determine a degree of similarity between the component and the portion, wherein the degree of similarity is a first degree of similarity; and a selector operable to select the portion of the pre-recorded musical composition based on the first degree of similarity between the first and second parameters, and on a second degree of similarity between the first and second parameters, wherein the first and second parameters are less similar in the second degree of similarity than the first and second parameters in the first degree of similarity.

14. The system of claim 13 wherein the component received includes at least one of the following:

a chord included in the musical composition, a chord, a root of the chord, and an extension of the chord included in the musical composition, a chord progression included in the musical composition, a key signature for the musical composition, and a musical style for the composition.

15. The system of claim 13 wherein the first parameter includes at least one of the following:

a scale associated with the component, wherein the scale includes tones that when played simultaneously with the component are in harmony with the component, one or more tones included in the component, a relative root of the component.

16. The system of claim 13 wherein the first parameter includes at least one of the following:

a scale associated with the component, wherein the scale is defined by a chord root of a chord of the component, and a chord extension of the chord of the component, one or more tones included in the component, a relative root of the component.

17. The system of claim 13 wherein the first parameter includes at least one of the following:

a scale associated with the component, wherein the scale includes tones that when played simultaneously with at least one chord of the component are in harmony with the at least one chord, one or more tones included in at least one chord of the component, a relative root of at least one chord of the component, and a key signature of the component.

18. The system of claim 13 wherein the retriever is operable to retrieve each portion of the one or more pre-recorded musical compositions included in the database.

19. The system of claim 13 wherein the second parameter includes at least one of the following:

one or more tones of one or more chords in the portion of the pre-recorded musical composition, one or more tones of one or more chord extensions of one or more chords in the portion of the pre-recorded musical composition, one or more tones of a scale associated with one or more chords in the portion of the pre-recorded musical composition, wherein the one or more tones are in harmony with the one or more chords, when the one or more tones are played simultaneously with the one or more chords, a key signature of the portion of the pre-recorded musical composition, the number of beats in the portion of the pre-recorded musical composition, and the number of times that the portion of the pre-recorded musical composition has been previously selected to be included in the musical composition.

20. The system of claim 13 wherein the selector is operable to select the portion of the pre-recorded musical composition if at least one of the following are met:

one or more tones of one or more chords in the portion of the pre-recorded musical composition are the same as one or more tones of the component, one or more tones of one or more chords in the portion of the pre-recorded musical composition are the same as one or more tones included in a scale associated with the component, wherein the one or more tones included in the scale are in harmony with the component when played simultaneously with the component, one or more tones of one or more chord extensions of one or more chords in the portion of the pre-recorded musical composition are the same as one or more tones of the component, one or more tones of one or more chord extensions of one or more chords in the portion of the pre-recorded musical composition are the same as one or more tones included in a scale associated with the component, wherein the one or more tones included in the scale are in harmony with the component when played simultaneously with the component, one or more tones of a scale associated with one or more chords in the portion of the pre-recorded musical composition, wherein the one or more tones are in harmony with the one or more chords, when the one or more tones are played simultaneously with the one or more chords, are the same as one or more tones of the component, one or more tones of a scale associated with one or more chords in the portion of the pre-recorded musical composition, wherein the one or more tones are in harmony with the one or more chords, when the one or more tones are played simultaneously with the one or more chords, are the same as one or more tones included in a scale associated with the component, wherein the one or more tones included in the scale are in harmony with the component when played simultaneously with the component, a key signature of the portion of the pre-recorded musical composition is the same as the key signature of component, the number of beats in the portion of the pre-recorded musical composition exceeds 4, and the portion of the pre-recorded musical composition has not been previously selected to be included in the musical composition.

21. The system of claim 13 further comprising assembling the selected portion to the component to generate the musical composition.

22. A storage medium storing a program that, when executed by a computer, causes the computer to:

determine a first parameter based on a component of a musical composition that is received by the program;

retrieve a portion of a pre-recorded musical composition from a database that includes portions of one or more pre-recorded musical compositions;

determine a second parameter based on the retrieved portion;

compare the first parameter to the second parameter to determine a degree of similarity between the component and the portion, wherein the degree of similarity is a first degree of similarity;

select the portion of the pre-recorded musical composition based on the first degree of similarity between the first and second parameters, and on a second degree of similarity between the first and second parameters, wherein the first and second parameters are less similar in the second degree of similarity than the first and second parameters in the first degree of similarity.

23. The medium of claim 22 wherein the program, when executed by a computer, causes the computer to determine the first parameter which includes at least one of the following:

a scale associated with the component, wherein the scale includes tones that when played simultaneously with the component are in harmony with the component, one or more tones included in the component, a relative root of the component.

24. The medium of claim 22 wherein the program, when executed by a computer, causes the computer to determine the first parameter which includes at least one of the following:

a scale associated with the component, wherein the scale is defined by a chord root of a chord of the component, and a chord extension of the chord of the component, one or more tones included in the component, a relative root of the component.

25. The medium of claim 22 wherein the program, when executed by a computer, causes the computer to determine the first parameter which includes at least one of the following:

a scale associated with the component, wherein the scale includes tones that when played simultaneously with at least one chord of the component are in harmony with the at least one chord, one or more tones included in at least one chord of the component, a relative root of at least one chord of the component, and a key signature of the component.

26. The medium of claim 22 wherein the program, when executed by a computer, causes the computer to retrieve each portion of the one or more pre-recorded musical compositions included in the database.

27. The medium of claim 22 wherein the program, when executed by a computer, causes the computer to determine the second parameter which includes at least one of the following:

one or more tones of one or more chords in the portion of the pre-recorded musical composition, one or more tones of one or more chord extensions of one or more chords in the portion of the pre-recorded musical composition, one or more tones of a scale associated with one or more chords in the portion of the pre-recorded musical composition, wherein the one or more tones are in harmony with the one or more chords, when the one or more tones are played simultaneously with the one or more chords, a key signature of the portion of the pre-recorded musical composition, the number of beats in the portion of the pre-recorded musical composition, and the number of times that the portion of the pre-recorded musical composition has been previously selected to be included in the musical composition.

28. The medium of claim 22 wherein the program, when executed by a computer, causes the computer to select the portion of the pre-recorded musical composition if at least one of the following are met:

one or more tones of one or more chords in the portion of the pre-recorded musical composition are the same as one or more tones of the component, one or more tones of one or more chords in the portion of the pre-recorded musical composition are the same as one or more tones included in a scale associated with the component, wherein the one or more tones included in the scale are in harmony with the component when played simultaneously with the component, one or more tones of one or more chord extensions of one or more chords in the portion of the pre-recorded musical composition are the same as one or more tones of the component, one or more tones of one or more chord extensions of one or more chords in the portion of the pre-recorded musical composition are the same as one or more tones included in a scale associated with the component, wherein the one or more tones included in the scale are in harmony with the component when played simultaneously with the component, one or more tones of a scale associated with one or more chords in the portion of the pre-recorded musical composition, wherein the one or more tones are in harmony with the one or more chords, when the one or more tones are played simultaneously with the one or more chords, are the same as one or more tones of the component, one or more tones of a scale associated with one or more chords in the portion of the pre-recorded musical composition, wherein the one or more tones are in harmony with the one or more chords, when the one or more tones are played simultaneously with the one or more chords, are the same as one or more tones included in a scale associated with the component, wherein the one or more tones included in the scale are in harmony with the component when played simultaneously with the component, a key signature of the portion of the pre-recorded musical composition is the same as the key signature of component, the number of beats in the portion of the pre-recorded musical composition exceeds 4, and the portion of the pre-recorded musical composition has not been previously selected to be included in the musical composition.

29. The medium of claim 22 wherein the program, when executed by a computer, further causes the computer to assemble the selected portion to the component to generate the musical composition.

* * * * *